US009296212B2

(12) United States Patent
Gonzalez

(10) Patent No.: US 9,296,212 B2
(45) Date of Patent: Mar. 29, 2016

(54) INK TANK PARTS

(71) Applicant: Hewlett-Packard Development Company, L.P., Houston, TX (US)

(72) Inventor: Segi Gonzalez, Añasco, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/429,094

(22) PCT Filed: Nov. 29, 2012

(86) PCT No.: PCT/US2012/066980

§ 371 (c)(1),
(2) Date: Mar. 18, 2015

(87) PCT Pub. No.: WO2014/084825

PCT Pub. Date: Jun. 5, 2014

(65) Prior Publication Data

US 2015/0217573 A1 Aug. 6, 2015

(51) Int. Cl.
*B41J 2/175* (2006.01)

(52) U.S. Cl.
CPC ..... *B41J 2/175* (2013.01); *B41J 2/17509* (2013.01); *B41J 2/17553* (2013.01)

(58) Field of Classification Search
CPC ..... B41J 2/175; B41J 2/17506; B41J 2/1755; B41J 2/17513; B41J 2/17523; B41J 2/17553
USPC ..... 347/85, 86
See application file for complete search history.

(56) References Cited

U.S. PATENT DOCUMENTS

| | | | | |
|---|---|---|---|---|
| 1,875,866 | A * | 9/1932 | Harris et al. | 141/20.5 |
| 1,932,765 | A * | 10/1933 | Bienenstein | 222/578 |
| 4,997,429 | A | 3/1991 | Dickerhoff et al. | |
| 5,406,991 | A * | 4/1995 | Rathenberg et al. | 141/18 |
| 6,467,888 | B2 * | 10/2002 | Wheeler et al. | 347/85 |
| 6,550,894 | B2 * | 4/2003 | Ueno et al. | 347/49 |
| 6,783,024 | B2 * | 8/2004 | Lee | 220/707 |
| 7,165,833 | B2 | 1/2007 | Graham et al. | |
| 7,470,008 | B2 * | 12/2008 | Yan | 347/84 |
| 7,478,739 | B2 | 1/2009 | Foster | |
| 9,016,505 | B2 * | 4/2015 | Canegallo | 220/277 |
| 2007/0076064 | A1 | 4/2007 | Wang et al. | |
| 2011/0226806 | A1 | 9/2011 | O'Dougherty et al. | |
| 2012/0169811 | A1 | 7/2012 | Lin | |

FOREIGN PATENT DOCUMENTS

| | | | |
|---|---|---|---|
| JP | 2000272149 | A | 10/2000 |
| JP | 2003136746 | A | 5/2003 |
| WO | WO0228646 | A1 | 4/2002 |

* cited by examiner

*Primary Examiner* — Anh T. N. Vo
(74) *Attorney, Agent, or Firm* — HP Inc. Patent Department

(57) ABSTRACT

In one example an ink tank cap is provided. In another example an ink tank body is provided. For example, in assembled condition, the cap is affixed to the body in a predefined rotational orientation.

15 Claims, 5 Drawing Sheets

INK TANK PARTS

BACKGROUND

Printer ink tanks contain a volume of ink for printers. Large format ink tanks are ink tanks for large format printers and typically contain relatively large volumes of ink, for example of more than one liter of ink. Existing examples of large format ink tanks are arranged to be emptied into permanent ink tanks in the large format printer. This creates a risk that ink is spilled. Other existing example ink tanks are arranged to be fluidically connected to the printer and supply ink to the printer in a connected state. Such ink tank is placed on, or close to, the printer during usage, and connected to an ink inlet. The ink is drawn from the ink tank by a pump or other ink suction device wherein an internal bag flexes to compensate for a changing backpressure in the bag.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Although certain features are shown and described in conjunction they may be applied separately to the ink tank of this description, also if not specifically claimed. Furthermore, it may be understood that examples or elements that are not literally described may be derived from the description and drawings by a person of ordinary skill in the art.

Figure 1:
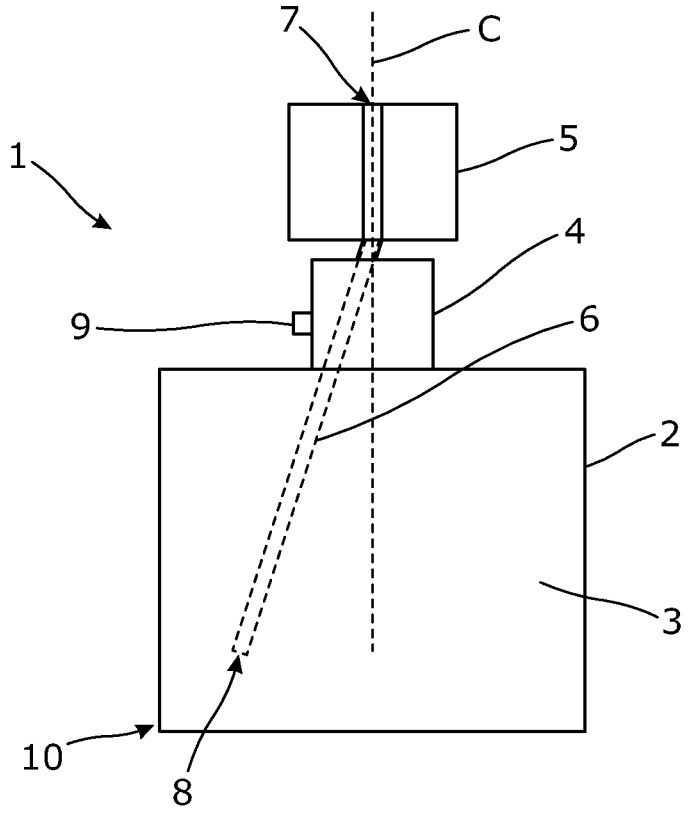
FIG. 1 illustrates a diagram of an example of an ink tank body and an ink tank cap with tube before assembly, in front view.
Figure 2:
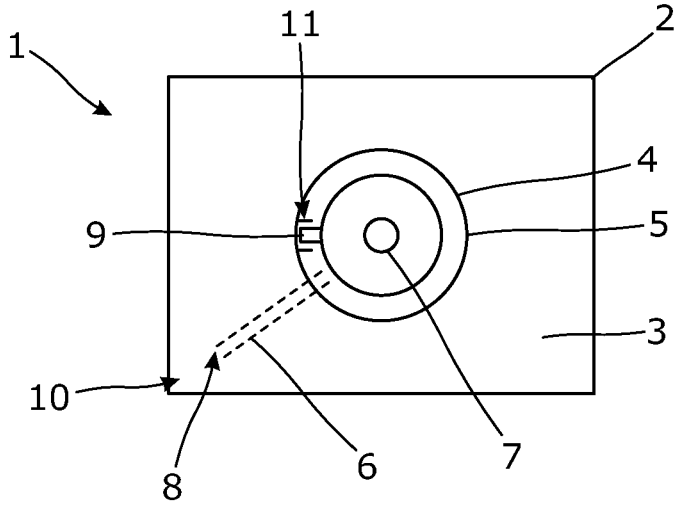
FIG. 2 illustrates a diagram of the example ink tank body and an ink tank cap of FIG. 1 in top view.

FIGS. 1 and 2 illustrate an example of an ink tank 1 before assembly, in front and top view, respectively. The ink tank 1 includes a body 2 having an internal volume 3 for holding ink, and a neck 4. For example the body 2 consists of rigid or semi-rigid walls that do not need further support structures to allow the ink tank 1 to stand by itself in a filled or unfilled state, nor an additional bag to hold the ink. For example, in a filled state and/or during usage, the ink directly contacts the body walls and the body walls are in direct contact with ambient air.

The ink tank 1 includes a cap 5 connected to the neck 4. For example the body 2 and the cap 5 are separate parts that can be assembled at manufacture after filling the internal volume 3 with ink. For example, the cap 5 can be snap fitted to the body 2. For example, the cap 5 includes an outlet 7, for example an ink outlet. For example, an ink supply tube 6 is connected to the outlet 7 to supply ink out of the inner volume 3 to the outlet 7. The tube 6 has a thin, elongate shape for example to extend from the cap 5 up to near a lowest point of the inner volume 3 during use, such as a bottom or bottom corner or at least near a lowest point of gravity of the inner volume, for emptying the ink tank 1 during use. For example in installed condition the ink supply tube 6 extends into the internal volume 3 of the body 2. In an example, the cap 5 or outlet 7 is arranged to connect to a further adaptor or connector or printer (not shown).

For example, the neck 4 or cap 5 is arranged so that the cap 5 has a predefined rotational orientation with respect to the neck 4 and body 2, and adapted to preventing tampering of such orientation by an end user. The predefined rotational orientation of the cap 5 can ensure that the ink supply tube 6 is maintained in a predefined orientation so that its inlet 8 terminates in a predefined region of the inner volume 3, such as near a lowest point of the inner volume 3 during usage, which may be a bottom corner. In an example the ink supply tube 6 is partly flexible for bending and/or has rigid properties to allow it to stay in position. For example, there may be some rotational margin or tolerance in the predefined rotational orientation of the cap 5 as long as the tube 6 maintains its desired position in use. For example there may be margin of a couple of degrees, for example 10 degrees or less or 5 degrees or less.

For example, at least one of the cap 5 and neck 4 includes a stop 9 to prevent rotation of the cap 5 with respect to a central axis C of the neck 4. For example, a stop engagement surface 11 is provided in the neck 4 or cap 5, respectively, to engage the stop 9. For example, the stop 9 engages the corresponding surface 11 of the neck 4 or cap 5, respectively, to avoid rotation about the central axis C and maintain the tube 6 in position.

For example, the predefined region of the inlet 8 is a bottom or bottom corner 10 of the internal volume 3, or at least a lowest point of the inner volume 3 during usage, so that most or all ink can be supplied to the outlet 7 during use. The skilled person will understand that which tank wall defines the bottom can depend on the orientation of the ink tank 1 during usage. In an example the bottom is defined by a bottom wall in a use condition of the ink tank 1, for example when the ink tank 1 supplies ink to a printer during printing. For example a bottom of the ink tank 1 during transport can be different than a bottom of the ink tank 1 when it is connected to a printer or other device for depletion.

Figure 3:
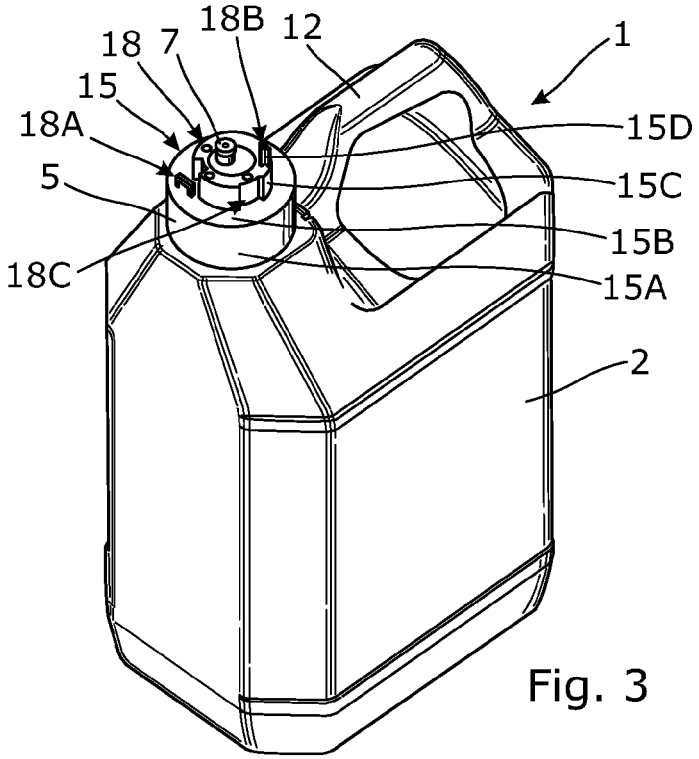
FIG. 3 illustrates an example of an assembled ink tank in perspective view.

FIG. 3 illustrates another example ink tank 1 having its body 2 and cap 5 in a pre-assembled state. The cap 5 includes a top wall 15 and a cylindrically walled skirt 14 extending downward from the top wall 15, for example under an at least substantially straight angle with the top wall 15. The top wall 15 can include multiple top walls at multiple height levels. In the illustrated example, the skirt 14 is defined by multiple side walls 15A, 15C at different heights that are truncated by different top walls 15B, 15D at different heights. For example, a substantial portion of the cap 5 is defined by a rigid or semi rigid single-cast self-supporting structure. For example a single cast plastic body 2 and cap 5 can be used for transporting the ink tank 1 in a filled state and the same ink tank 1 can be used for direct or indirect connection to a printer to serve as a printer ink supply during printing.

For example, the ink tank 1 is provided with rigid walls. For example, the ink tank 1 is bagless, that is, not provided with a flexible bag, contrary to conventional large volume ink tanks (not shown) that are sometimes provided with flexible bags for holding ink or air. These flexible bags can have different functions amongst which backpressure regulation, gas impermeability, transport requirement fulfillment or preventing chemical reaction with the rigid walls. The conventional flexible bags are typically arranged so as to move with respect to the outer box. In the shown example ink tank 1, the ink is directly contained by the rigid walls, not by a flexible bag. However, it is not excluded that an example ink tank 1 of this disclosure includes a foil or lining or the like that is placed against the inside of the walls for example to enhance fluid impermeability or prevent chemical reaction with the ink. For example, the material of the rigid walls can be chosen to prevent chemical reaction with Ultra-Violet curable ink. For example, the inner volume of the ink tank 1 holds ultraviolet curable ink. Ultraviolet curable inks well-known in the industry and are ink compounds that are design to be cured by ultraviolet radiation. For example, suitable polymer containing material such as plastic can be chosen to mold the ink tank parts including the body 2 and cap 5. For example the ink tank walls include HDPE (High-Density Polyethylene). For example, the cap 5 includes PP (Polypropylene). For example, the ink tank 1 has an inner volume 3 large enough to contain at least approximately one, at least approximately three, at least approximately four, or at least approximately five liters of ink such as ultraviolet ink. In other examples, the inner volume 4 contains at least approximately ten liters, or at least approximately 15 liters of ink. For example, the body 2 includes a handle 12 that is co-molded with the body 2.

For example, the cap 5 includes an ink outlet 7 arranged to be fluidically connected to the tube 6 on the inside and on the outside to an adaptor or printer to supply the ink out of the inner volume 3 and out of the tube 6 to a printer. For example, the cap 5 includes further interface features 18 such as at least one of a chip, an adaptor interconnect latch feature 18C, a key lock out feature 18B and a vent device 18A. For example, these interface features 18 interface with connector or printer elements at least at some point during usage. For example, some of the interface features 18 protrude from the top wall 15 of the cap 5.

For example, the vent device 18A provides for an ambient air opening in the ink tank 1 during usage. For example, the vent device 18A is closed before usage and is arranged to break open when beginning usage, for example by connecting a connector. The chip can include a memory or integrated circuit or microprocessor and is designed for interconnection with a printer or adaptor connector for one- or two-way data or signal exchange. In one example, the chip is designed to interconnect with printer electrodes, triggering a signal in the printer that the tank 1 has been connected, for example the signal also indicating a color or ink type pertaining to the ink tank 1.

For example the interface features 18 are provided at different height levels of the top wall 15 of the cap 5 to engage with corresponding interface features of an adaptor or connector. In an example, a first top wall 15B extends at a first level truncating a first cap side wall 15A, a second cap side wall 15C protrudes from the first top wall 15B, and a second top wall 15D truncates that second side wall 15C, and the ink outlet 7 protrudes from the second top wall 15D. For example the vent device 18A extends from the first top wall 15B, the latch feature 18A extends in the second side wall 15C, the key feature 18B and ink outlet 7 extend from the second top wall 15D and the chip extends in the second top wall 15D. For example, the interface features 18 have predetermined positions with respect to each other to be able to connect with the adaptor or connector. For example, the predefined rotational orientation of the cap 5 with respect to the neck 4 facilitates a predefined rotational position of the interface features 18 with respect to the central axis C of the neck 4 (schematically illustrated in FIG. 1), and hence, of a connector with respect to the ink tank 1. For example, this facilitates that said adaptor or connector connects to the cap 5 in a predefined rotational orientation, and also that the interface features 18 that are arranged at different height levels connect to the adaptor or connector in a predetermined order. For example, when an adaptor or connector is connected to the cap 5 it first engages the key feature 18B, then it engages the vent device 18A, and then it latches to the latch feature 18C and connects to the chip, the latter for example triggering an activation or release in the print system.

Figure 4:
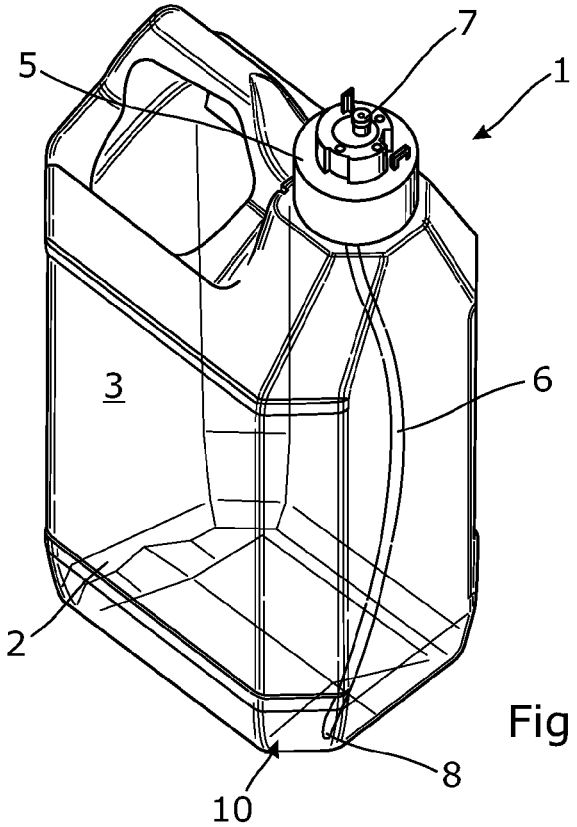
FIG. 4 illustrates a partly transparent version of the example ink tank of FIG. 3 in perspective view, including an example tube inside the tank.

In FIG. 4 the body 2 of FIG. 3 is made transparent. The ink supply tube 6 extends from the ink outlet 7 up to a point close to a bottom corner 10 of the volume 3. For example, the ink supply tube 6 is arranged to transport ink from the inner volume 3 to the ink outlet 7. For example, the ink supply tube 6 includes an at least partly flexible tubular wall. For example, the ink supply tube 6 includes a material that is compatible with ultraviolet curable inks including plastics or elastomers. For example, the ink supply tube 6 is partly flexible for bending and repositioning and partly rigid for maintaining a certain orientation or shape. For example, in a mounted condition of the cap 5 the tube 6 is clamped between the tube connector barb and a bottom corner 10 of the inner volume 3, in a slightly bended shape.

For example the tube 6 includes a positioner for positioning and maintaining at least the inlet 8 of the tube 6 in a predefined orientation. For example in one example, the tube 6 includes at least one metal wire. For example, the metal wire may be attached to the tube 6, or is co-molded with the tube material, or is glued to the tube 6, or extends around the tube 6 for example in a spiraled manner. In the illustrated example a thin metal wire is included in the ink supply tube wall. In another example the positioner can be an attachment device that is arranged in or near the bottom 10 to hold the inlet end 8 of the tube 6 close to the bottom 10. In another example there is no positioner. For example, the tube 6 allows for self-positioning without additional positioner. For example, the tube includes only plastic material and is held in place between cap and bottom (as shown). For example the tube 6 has a slightly bended shape and the inlet end touches the bottom corner 10 while the other end is attached to the ink outlet 7 or a tube connector 16, 17 connected to the ink outlet 7 (see FIGS. 5, 6). For example the inlet 8 is held in the bottom corner region using only the force generated from bending it between the barb 16, 17 on one end and the bottom corner 10 of the tank 1 on the other end.

Figure 5:
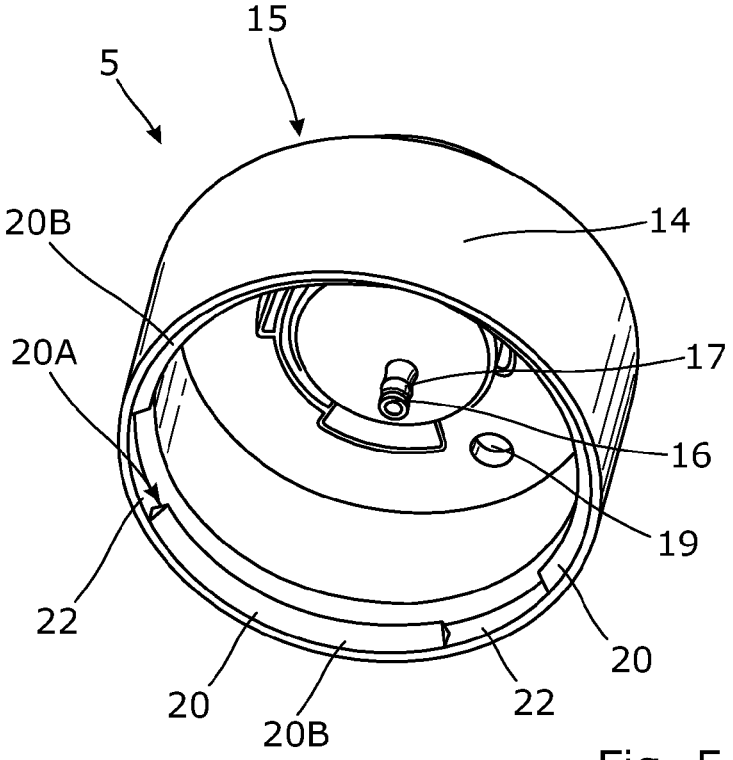
FIG. 5 illustrates an example of an ink tank cap without tube in perspective view.
Figure 6:
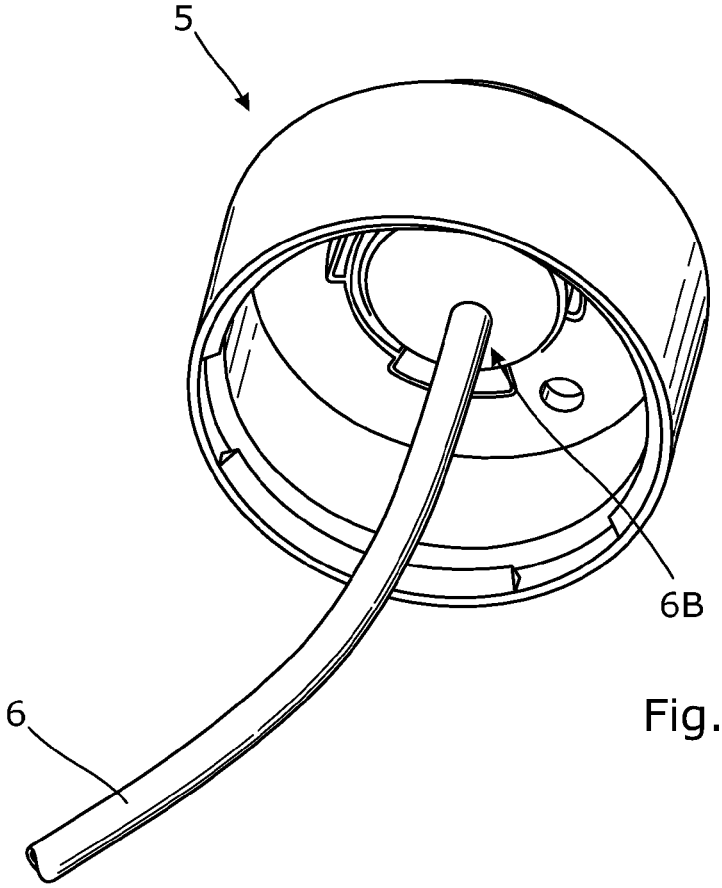
FIG. 6 illustrates the example ink tank cap of FIG. 5 with tube.

FIGS. 5 and 6 illustrate an example of an ink tank cap 5 for connection to the ink tank body 2, including said tube connector 16 and barb 17. For example, the cap 5 is mostly defined by a single cast. For example, certain parts such as a chip, seal rings, outlet seals or valves can be assembled afterwards. In FIG. 5 the ink supply tube 6 has not yet been attached to the cap 5 and in FIG. 6 the ink supply tube 6 has been attached to the cap 5. In the example of FIG. 5, a tube connector 16 protrudes downwards from the bottom side of the top wall 15. The tube connector 16 is fluidically connected to the outlet 7, for example sharing a common inner channel, for transporting ink out of the inner volume 3. For example, the tube connector 16 is arranged to be fluidically connected to the tube 6. For example, the tube connector 16 has a substantially cylindrical shape, including one or more flanges and/or barbs 17. For example, the tube connector 16 includes one or multiple barbs 17 for connection to the ink inlet tube 6. For example, during assembly a flexible end portion 6B of the tube 6 is slid onto the tube connector 16, around barbs 17. For example, the flexible end portion 6B is stretched so that a substantially liquid tight connection is achieved between the tube connector 16 and the tube 6.

Furthermore in one example the inner portion of the top wall of the cap 5 includes a cut out 19. For example the cut out 19 is a component of the earlier mentioned vent device. For example the cut out 19 facilitates relatively easy local rupturing of the cap's top wall 15 for creating a vent hole through rupture.

For example, the cap 5 includes at least one snap ridge 20 extending inwardly from inner walls 21 of the cylindrical skirt 14 (FIG. 5). For example, the cap snap ridge 20 does not extend over a full circle, that is, the cap snap ridge 20 extends over less than 360 degrees of the cylindrical inside surface, or for example less than 120 degrees in case of multiple cap snap ridges 20, therewith creating at least one non-ridge zone 22 next to the ridge 20. For example, the snap ridge 20 has a top abutment surface 20A extending inwards under an angle of approximately 90 degrees or less with respect to the inner wall. This angle of approximately 90 degrees or less facilitates a difficult return of the cap 5 after the cap 5 has been snap fitted to the neck 4. For example the snap ridge 20 includes an inclined slide surface 20B for allowing the snap ridge 20 to slide over a corresponding slide surface of a snap ridge of the neck 4. Once the slide surface 20B of the cap's ridge 20 has passed over a corresponding ridge of the neck 4, the cap's ridge 20 and skirt 14 snap inwards and the cap 5 is fixed to the neck 4. For example, the cap 5 includes at least one non-ridge zone 22 next to an end of the ridge 20 and/or between multiple ridges 20. In the illustrated example, the cap 5 includes three snap ridges 20 and three non-ridge zones between the snap ridges 20. The non-ridge zone 22 allows for a stop or protrusion to extend between the ridges 20 or next to a ridge 20 to prevent rotation of the cap 5 around the neck 4.

Figure 7:
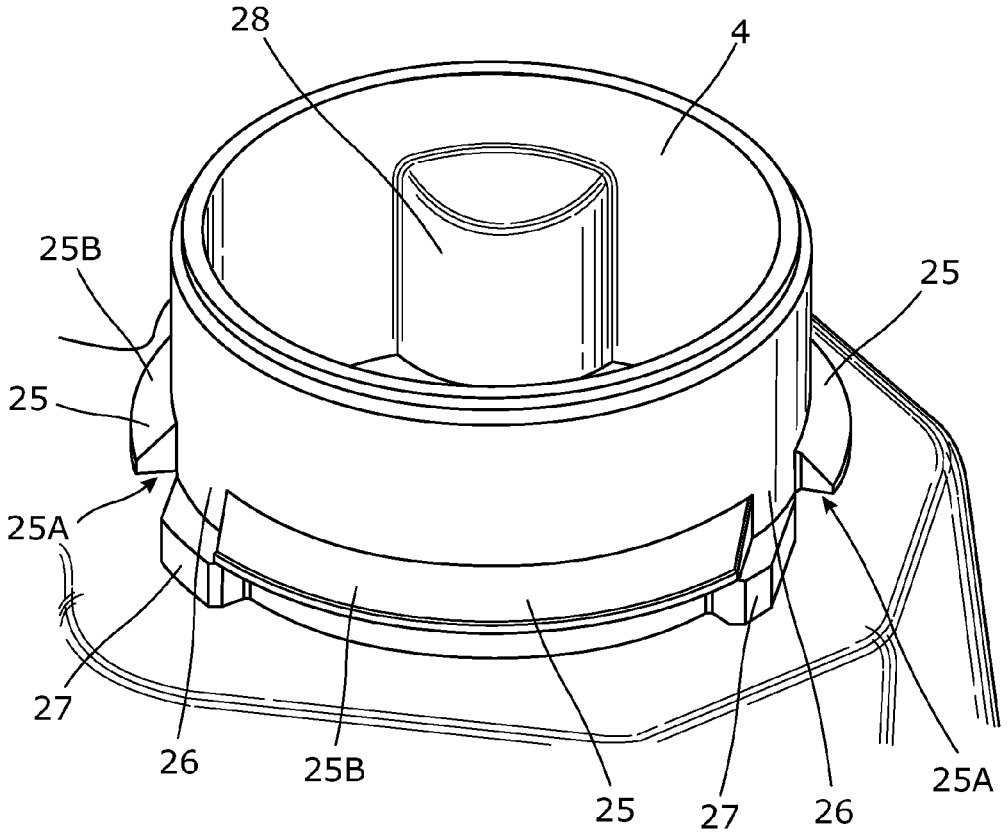
FIG. 7 illustrates an example of an ink tank neck, in perspective view.

FIG. 7 illustrates an example of a cylindrical bottle neck portion 4 comprising at least one outwardly extending snap ridge 25 on the outer wall of the neck 4. For example, the neck's at least one outwardly extending snap ridge 25 is arranged to snap fit to a corresponding at least one inwardly extending snap ridge 20 of the cap 5. For example neck non-ridge zones 26 are provided next to an end of the neck ridge 25 and/or between the neck ridges 25. In the illustrated example three outwardly extending snap ridges 25 are provided, and three corresponding non-ridge zones 26 are provided between the snap ridges 25. For example, the neck's snap ridge 25 includes a bottom abutment surface 20A of an angle of approximately 90 degrees with respect to the outer wall of the neck 4. For example, neck snap ridge 25 includes an inclined slide surface 25B for allowing the cap's ridge 20 to slide over the neck's snap ridge 25. For example, the neck 4 and/or neck's ridges 25 may be partly pushed inwards when the cap's ridges 20 slide over the neck's ridges 25, and may "snap" outwards when the cap's ridges 20 pass the bottom abutment surface 25A of the neck snap ridges 25. For example, the bottom abutment surface 25A of the neck snap ridge 25 engages the top abutment surface 20A of the cap snap ridge 20 to block the cap 5 from being taken off the body 2, while a stop 27 blocks a rotational movement of the cap 5.

As illustrated in the example of FIG. 7, at least one stop 27 is arranged next to an end of the neck's snap ridge 25 and/or between the neck's snap ridges 25. For example, the stop 27 includes a protrusion that extends outwardly from the outer wall of the neck 4, next to the neck's snap ridge 25 and below the neck's snap ridge 25 so that the stop 27 engages a side of a cap's snap ridge 20 when the cap 5 is mounted to the neck 4 (also see FIG. 8). For example, in mounted condition the stop 27 extends in a non-ridge zone 22 of the inner wall of the skirt 14 of the cap 5. By abutting the cap ridges 20, the stop 27 prevents rotation of the cap 5 with respect to the neck 4. For example the stop 27 includes a stop slide surface 27B and a stop surface 27A. The stop surface 27A is arranged to stop the cap's snap ridge 20 from rotation. The stop slide surface 27B is arranged to allow some rotation of the cap 5 when during the snapping of the cap 5 on the neck 4 one of the cap's snap ridges 20 lies on the stop 27. When such occurs, the cap ridge 20 can be rotated over the stop slide surface 27B until the end of the cap's snap ridge 20 is released from the stop 27 and snaps inwards.

When the cap and neck's inclined slide surfaces 20B, 25B slide over each other, the neck 4, skirt 14, and/or snap ridges 20, 25 need to partly deform to allow the snap ridges 20, 25 to snap into a locked position. In an example, the neck 4 includes a locally deformed wall part 28 such as a nose, cylindrical shape, cut out or the like that extends inwards and may facilitate easier deformation of the neck 4 when the cap 5 snaps over the neck 4. In another example, no such deformed wall part 28 is provided.

Figure 8:
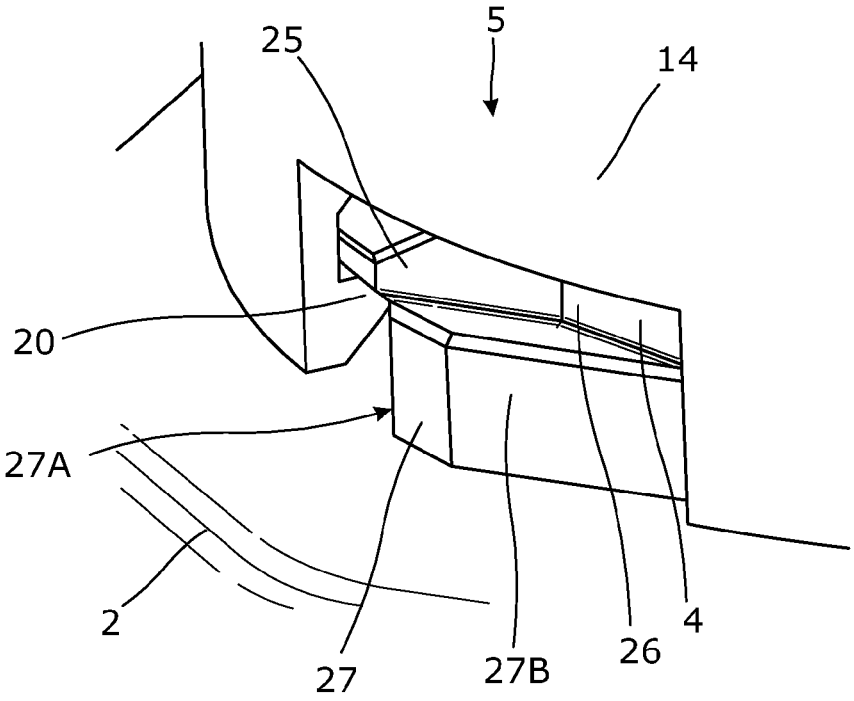
FIG. 8 illustrates an example of the example cap of FIGS. 5 and 6, mounted to the example neck of FIG. 7 wherein a portion of the wall of the cap is cut out for illustrative purposes.

FIG. 8 illustrates an example of a cap 5 that is mounted on the neck 4 of the body 2 of the ink tank 1. In the shown example, the abutment surfaces 20A, 25A of the cap 5 and neck 4, respectively, abut and prevent that the cap 5 can be removed from the neck 4, therewith preventing opening of the ink tank 1. A portion of the wall of the skirt 14 of the cap 5 is cut away to illustrate the relative positions of the snap ridges 20, 25 and stop 27 in assembled state. The skirt wall portion has been cut away where in use a cap's non-ridge zone 22 resides. As can be seen, the abutment surfaces 20A, 25A of the respective snap ridges 20, 25 abut. In assembled condition, the stop 27 of the neck 4 resides next to the snap ridge 20 of the cap 5, in the non-ridge zone 22, preventing rotation of the cap 5. For example, a non-ridge zone 26 of the neck 4 resides above the stop 27 and next to the neck's snap ridge 25, for example facilitating mold release during manufacture of the body 2.

Figure 9A:
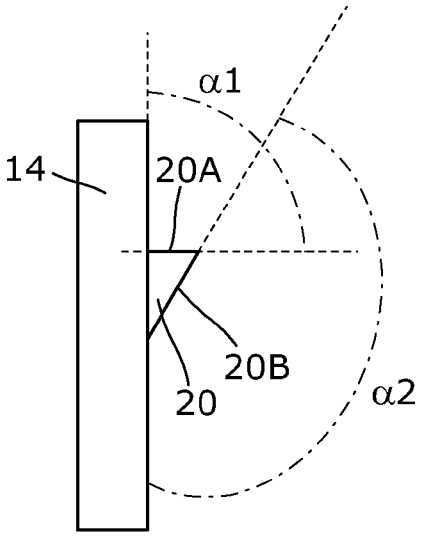
FIG. 9A illustrates a diagram of an example of a portion of the cap.

FIG. 9A illustrates an example of a cross section of a portion of a skirt wall of the cap 5. For example, the snap ridge 20 extends inwards and has a top abutment surface 20A that has an approximately straight angle $\alpha 1$ with respect to the inner wall of the skirt 14. For example, the angle $\alpha 1$ can also be less than 90 degrees. Because of such angle $\alpha 1$ of 90 degrees or less it is difficult to remove the cap 5 after snapping in.

The snap ridge 20 of the cap 5 further includes an inclined slide surface 20B for sliding the snap ridge 20 over the corresponding snap ridge 25 of the bottle neck 4. This inclined slide surface 20B extends inwards from the skirt's inner wall under an angle $\alpha 2$ of more than 90 degrees, for example at least approximately 120 degrees, for example at least approximately 135 degrees with respect to the inner wall to allow the snap ridge 20 to slide over the corresponding neck snap ridge 25 until it is snap fitted.

Figure 9B:
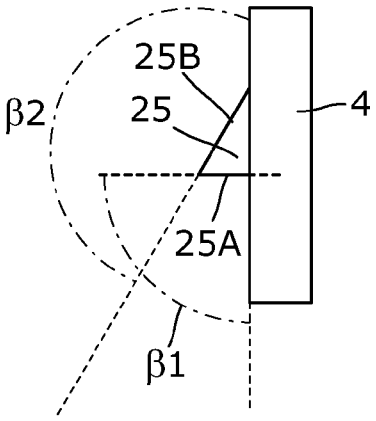
FIG. 9B illustrates a diagram of an example of a portion of the neck.

FIG. 9B illustrates an example of a cross section of a portion of a neck wall. For example the neck 4 includes at least one snap ridge 25 extending outwards. For example, the neck's snap ridge 25 has a bottom abutment surface 25A that has an angle $\beta 1$ of approximately 90 degrees or less with respect the neck 4. For example, the neck's snap ridge 25 has an inclined slide surface 25B that extends outwards from the neck's outer wall under an angle β2 of more than 90 degrees, for example at least approximately 120 degrees, for example at least approximately 135 degrees with respect to said outer wall to allow the neck snap ridge 25 and cap snap ridge 20 to slide over each other.

The skilled person will appreciate that angles and dimensions given in this description include certain margins, for example as a result of mold release tolerances. As the skilled person will understand certain features of the examples of FIGS. 3-9 can be left out, or can be applied to other examples such as the examples of FIGS. 1 and 2. For example different ridge designs are possible, other than the ones illustrated in FIGS. 5-9. For example, the ridge is formed by a protruding rib, thread, a protruding or intruding wall portion, a notch, a slot, border, etc. In addition to or instead of the stop 9, 27 and the non-ridge zone 22, different rotation preventing arrangements are possible. For example the cap 5 can include a cut out through which a neck portion such as a protrusion extends, preventing rotation of the cap, or for example a structure such as a thread, strip or film can be fixed to both the body 2 and cap 5 to prevent rotation. For example, a stop 9, 27 can be provided onto the cap 5 instead of the body 2.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. An ink tank, comprising:

a body including a neck, an external surface of the neck including a first snap ridge and a stop, the neck including an aperture to enable access to an internal volume of the body, the internal volume to hold ink; and;

a cap coupled to the neck and covering the aperture, the cap including an ink outlet, an internal surface of the cap including a second snap ridge and a third snap ridge, a radial space being defined between a first end of the second snap ridge and a second end of the third snap ridge, the first snap ridge including first tapered surfaces to oppose second and third tapered surfaces of the respective ones of the second and third snap ridges to enable the cap to be coupled to the neck, the first and second ends of the respective ones of the second and third snap ridges being disposed on opposing sides of the stop, the first and second ends to interact with the stop to hold the cap in a relatively fixed rotational orientation with respect to the neck to enable an ink supply tube coupled to the cap and extending into the internal volume to have an end in a region of the internal volume to enable ink to be drawn from the internal volume.

2. The ink tank of claim 1 wherein the ink inlet terminates near a bottom of the ink tank.

3. The ink tank of claim 1, wherein the stop prevents rotation of the cap with respect to the neck.

4. The ink tank of claim 1, wherein the stop is positioned to prevent rotation of the cap.

5. The ink tank of claim 1, wherein the first snap ridge has a bottom abutment surface having an angle of approximately 90 degrees or less with respect to an outer wall of the neck.

6. The ink tank of claim 1, wherein the second snap ridge has a top abutment surface extending inwards under an angle of approximately 90 degrees or less with respect to an inner wall of the cap.

7. The ink tank of claim 1, further including at least one of a positioner to maintain the end of the tube in the region, or a clamp to clamp the tube between the cap and a bottom corner of the ink tank, the tube having a bended shape.

8. The ink tank of claim 1, wherein the body includes a rigid or semi rigid single-cast self-supporting wall structure to directly contain the ink, the wall structure arranged to at least approximately maintain shape without additional internal or external support structures.

9. The ink tank of claim 1, wherein the internal volume is at least approximately 1 liter.

10. The ink tank of claim 1, wherein the internal volume contains ultraviolet curable ink.

11. An ink tank cap for connection to an ink tank body, the cap comprising:

a top wall, an ink outlet on the top wall, a cylindrical skirt extending downwards from the top wall, a tube connector fluidically connected to the ink outlet, a snap ridge extending inwardly from a surface of the skirt to snap fit the cap to the ink tank body, the snap ridge extending along the skirt over less than 360 degrees of the skirt, the snap ridge including a first end and a second end, the first end radially spaced from the second end to define a non-ridge zone of an inner- side wall of the skirt between the first and second ends, when the ink tank cap is coupled to a neck of the ink tank body, the first and second ends to interact with a stop of the ink tank body to hold the cap in a relatively fixed rotational orientation with respect to the ink tank body.

12. The ink tank cap of claim 11, wherein the snap ridge has a top abutment surface extending inwards from the inner-side wall under an angle of approximately 90 degrees or less with respect to the inner-side wall.

13. The ink tank cap of claim 11, further including:

a vent to provide ambient air into the ink tank body, a latch to latch with a corresponding connector, and a chip to be communicatively coupled to a printer.

14. The ink tank cap of claim 11, wherein the snap ridge includes a first snap ridge and a second snap ridge, the first snap ridge including the first end, the second snap ridge including the second end, the first end adjacent the second ridge.

15. A single cast plastic ink tank, comprising:

a body to contain ink, the neck defined by rigid or semi-rigid ink tank walls that are arranged to at least approximately maintain shape without additional internal or external support structures, while holding at least approximately one liter of ink, and a neck, the neck including an outwardly extending ridge, the outwardly extending ridge including a first end and a second end, the first end radially spaced from the second end, a stop of the neck at least partly disposed between the first and second ends, the stop at least partly spaced from the first and second ends along a longitudinal axis of the neck, when a cap is coupled to the neck, portions of the cap to interact with opposing sides of the stop to hold the cap in a relatively fixed rotational orientation with respect to the neck.

* * * * *